US011439864B2

(12) United States Patent
Tseng

(10) Patent No.: US 11,439,864 B2
(45) Date of Patent: Sep. 13, 2022

(54) FOLDABLE TREADMILL

(71) Applicant: XIAMEN DMASTER HEALTH TECH CO., LTD., Fujian (CN)

(72) Inventor: Ching Tseng, Taiwan (CN)

(73) Assignee: XIAMEN DMASTER HEALTH TECH CO., LTD., Fujian (CN)

( * ) Notice: Subject to any disclaimer, the term of this patent is extended or adjusted under 35 U.S.C. 154(b) by 23 days.

(21) Appl. No.: 17/252,896

(22) PCT Filed: May 26, 2020

(86) PCT No.: PCT/CN2020/092243
§ 371 (c)(1),
(2) Date: Dec. 16, 2020

(87) PCT Pub. No.: WO2021/031644
PCT Pub. Date: Feb. 25, 2021

(65) Prior Publication Data

US 2021/0275860 A1 Sep. 9, 2021

(30) Foreign Application Priority Data

Aug. 19, 2019 (CN) ..... 201921341921.9

(51) Int. Cl.
*A63B 22/02* (2006.01)
*A63B 21/00* (2006.01)
*A63B 71/06* (2006.01)

(52) U.S. Cl.
CPC ..... *A63B 22/02* (2013.01); *A63B 21/4035* (2015.10); *A63B 71/0619* (2013.01); *A63B 2210/50* (2013.01)

(58) Field of Classification Search
CPC ..... A63B 21/4033; A63B 21/4035; A63B 22/0015; A63B 22/0017; A63B 22/0023; A63B 22/0046; A63B 22/02; A63B 22/0235; A63B 22/0242; A63B 22/025; A63B 22/0257; A63B 71/0036;
(Continued)

(56) References Cited

U.S. PATENT DOCUMENTS 6,050,922 A 4/2000 Wang
7,867,147 B2 * 1/2011 Chu ..... A63B 22/02 482/54
10,065,070 B2 * 9/2018 Huang ..... A63B 22/02

FOREIGN PATENT DOCUMENTS

CN 206152183 U 5/2017
CN 206587325 U 10/2017
(Continued)

*Primary Examiner* — Gary D Urbiel Goldner
(74) *Attorney, Agent, or Firm* — Muncy, Geissler, Olds & Lowe, P.C.

(57) ABSTRACT

A foldable treadmill includes a chassis, a running platform, a dashboard, a dashboard bracket and two support rods. Each of two sides of a front portion of the chassis is pivotally connected with a pin shaft. The two pin shafts are parallel to each other. An end of each pin shaft is fixedly connected with a hook, and hook ends of the two hooks can be clamped into clamp positioning slots on the two support rods, respectively, with rotation of the two support rods. The two pin shafts are driven to rotate or reset synchronously through a linkage mechanism so that the two pin shafts drive the hook ends of the hooks to be separated from or clamped into the clamp positioning slots, respectively.

10 Claims, 13 Drawing Sheets

(58) Field of Classification Search
CPC ..... A63B 71/0619; A63B 2071/025; A63B 2071/0658; A63B 2210/00; A63B 2210/50; A63B 2210/58; A63B 2225/09; A63B 2225/093
See application file for complete search history.

(56) References Cited

FOREIGN PATENT DOCUMENTS

| | | | | | |
|---|---|---|---|---|---|
| CN | 108619662 | A | * | 10/2018 | ..... A63B 22/02 |
| CN | 208426583 | U | | 1/2019 | |
| CN | 209154997 | U | | 7/2019 | |
| TW | 201008609 | A | | 3/2010 | |

* cited by examiner

FOLDABLE TREADMILL

TECHNICAL FIELD

The present invention relates to a technical field of fitness equipment manufacturing, and in particular, to a foldable treadmill.

BACKGROUND

At present, treadmills have already been regular fitness equipment for homes and gyms, which greatly facilitate people's running exercises and allow people to exercise more scientifically. However, there is a problem with the treadmill, that is, it is not easy to store when not in use and occupies a lot of space. Therefore, treadmills that are easily folded and stored have begun to appear on the market. For example, the Chinese invention patent with the application No. ZL201621264386.8 and a title of "FOLD-TYPE TREADMILL" is disclosed on May 10, 2017, wherein the fold-type treadmill includes a base and a meter rack, the base includes a machine bracket, the meter rack includes two meter rods and a meter desk, both sides of the machine bracket are provided with a set of limiting assemblies for limiting rotation positions of the meter rods, respectively, the limiting assembly includes a limiting plate and a transfer bar, the limiting plate has an arc-shaped bar groove, each of both ends of the arc-shaped bar groove has a bayonet, an end of the transfer bar is hinged on the machine body, there is a limiting pin that is inserted through the limiting plate at a middle portion of the transfer bar, the limiting pin is slidably connected in the arc-shaped bar groove and can be engaged in or separated from the bayonet, wherein a transfer bar of a set of limiting assemblies has a pedal shaft for driving the transfer bar to rotate. The meter rack of such a treadmill can be folded relative to the base, facilitate storage, and save a storage space when the treadmill is idle. However, two transfer bars of such a treadmill are linked through a brake line, the synchronization of the linkage is poor, and the reliability of the folding operation needs to be further improved.

SUMMARY

The technical problem to be resolved by the present invention is to provide a foldable treadmill, which has a fast folding operation speed, a relatively high reliable action, and effectively reduces a storage space when the treadmill is idle.

In order to achieve the above purpose, a technical solution of the present invention is: a foldable treadmill including a chassis, a running platform, a dashboard, a dashboard bracket and two support rods, wherein the running platform is mounted on the chassis, upper portions of the two support rods are connected together through the dashboard bracket, the dashboard is mounted on the dashboard bracket, lower portions of the two support rods are pivotally connected to both sides of a front portion of the chassis, respectively, the lower portion of each of the support rods is provided with a clamp positioning slot, each of the both sides of the front portion of the chassis is pivotally connect with a pin shaft, two pin shafts are parallel to each other, an end of each pin shaft is fixedly connected with a hook, hook ends of two hooks can be clamped into the clamp positioning slots on the two support rods, respectively with rotation of the two support rods, the rotation of the support rod is restricted through cooperation of the hook and the clamp positioning slot;

the two pin shafts are driven to rotate or reset synchronously through a linkage mechanism so that the two pin shafts can drive the hook ends of the hooks to be separated from or clamped into the clamp positioning slots, respectively.

For further improvement, the lower portion of each of the support rods is fixedly connected with a fixing plate, the clamp positioning slot is disposed on the fixing plate, the fixing plate is further provided with a limiting part, the support rod is in a standing state when the hook end of the hook cooperates with the clamp positioning slot, and the support rod is in an inclined state and leans toward the chassis when the hook end of the hook cooperates with the limiting part.

Furthermore, the support rod is a square tube, the fixing plate is welded on an inner side surface of the lower portion of the support rod, a relief through hole is correspondingly disposed between the inner side surface of the lower portion of the support rod and the fixing plate, a fixing pin passes through the relief through hole so that an end thereof is fixedly connected on the chassis and the other end thereof is hinged with an end of a buffer cylinder, the other end of the buffer cylinder is hinged on the support rod, and the buffer cylinder is disposed so as to pass through a middle of the support rod. The buffer cylinder can reduce a downward rotation speed of the support rod to improve safety. The buffer cylinder is disposed so as to pass through the middle of the support rod to make the structure more compact and aesthetic.

For further improvement, the dashboard bracket comprises two armrests and a crossbar connecting the two armrests, the two armrests are connected at the upper portions of the two support rods, respectively, the dashboard is pivotally connected on the crossbar, a limiting structure for mutual positioning is further provided between the dashboard and the crossbar. In this way, the dashboard can be rotated and folded.

Furthermore, a lower portion of each of the armrests is fixedly connected with a positioning member, a side of the positioning member is hinged with the support rod, a shiftable positioning pin is mounted on the positioning member, a spring is coiled around the positioning pin, an end of the spring abuts against the positioning member and the other end abuts against the positioning pin so that an end of the positioning pin protrudes from the positioning member, the support rod is provided with a positioning hole, and an end of the positioning pin is inserted into the positioning hole when the armrest leans toward the support rod; an upper end of the support rod is fixedly connected with a housing, the housing is pivotally connected with a button, the button drives the positioning pin to be separated from the positioning hole when the button is pressed, and the armrest and the positioning member are rotatable relative to the support rod. This not only facilitates the mounting and positioning of the entire dashboard bracket, but also facilitates the rotation and folding of the dashboard bracket.

Furthermore, the limiting structure comprises two support plates that are fixedly connected with the crossbar, the dashboard is pivotally connected with the two support plates, each of the support plates is provided with a limiting slot, the dashboard is provided with two limiting projections, the two limiting projections and the two limiting slots cooperate with each other, respectively to position the dashboard.

Furthermore, the two armrests are integrally connected with the crossbar.

For further improvement, a front lower portion of the chassis is hinged with a rotating rack, the rotating rack is hinged with an end of a driving rod, an adjusting motor is connected on a reducer, the reducer is hinged on the chassis, an outside of an output shaft of the reducer is provided with external thread, the driving rod is fixedly connected with a nut, the external thread on the outside of the output shaft cooperates with inner thread of the nut, and both sides of a front end of the rotating rack are mounted with two support wheels. The rotating rack can be driven to rotate through rotation of the adjusting motor such that an inclination degree of the chassis can be changed to change sport effect. Different sport requirements of people are satisfied.

It is preferable that the linkage mechanism comprises two driving arms and two crank arms, an end of each of the crank arms is fixedly connected with the other end of the pin shaft and the other end of each crank arm is fixedly connected with a driving pin, each of the driving arms is pivotally connected on the chassis, an end of each driving arm is movably connected with the driving pin, two driving arms are fixedly connected together through a connecting rod, at least one driving arm and the chassis are connected to each other through a tension spring, at least one driving arm is fixedly connected with a pedal rod, the two driving arms rotate simultaneously when the pedal rod is depressed and then drive the two crank arms, the two pin shafts and the two hooks to rotate through the two driving pins, and the tension spring drives the two driving arms to reset.

For further improvement, an end of each driving arms is provided with a U-shaped groove and is movably connected with the driving pin through the U-shaped groove.

In the present invention, since the lower portions of the two support rods are pivotally connected to the both sides of the front portion of the chassis, respectively, the hook then cooperates with the clamp positioning slot to limit the rotation of the support rod to position the support rod. During the folding operation, the two pin shafts are driven to rotate or reset synchronously through a linkage mechanism so that the two pin shafts can drive the hook ends of the hooks to be separated from or clamped into the clamp positioning slots, respectively. The folding operation speed of the two support rods, the dashboard bracket and the dashboard is fast, the reliability of the action is high, and the storage space is effectively reduced when the treadmill is idle.

DETAILED DESCRIPTION OF THE EXEMPLARY EMBODIMENTS

Figure 1:
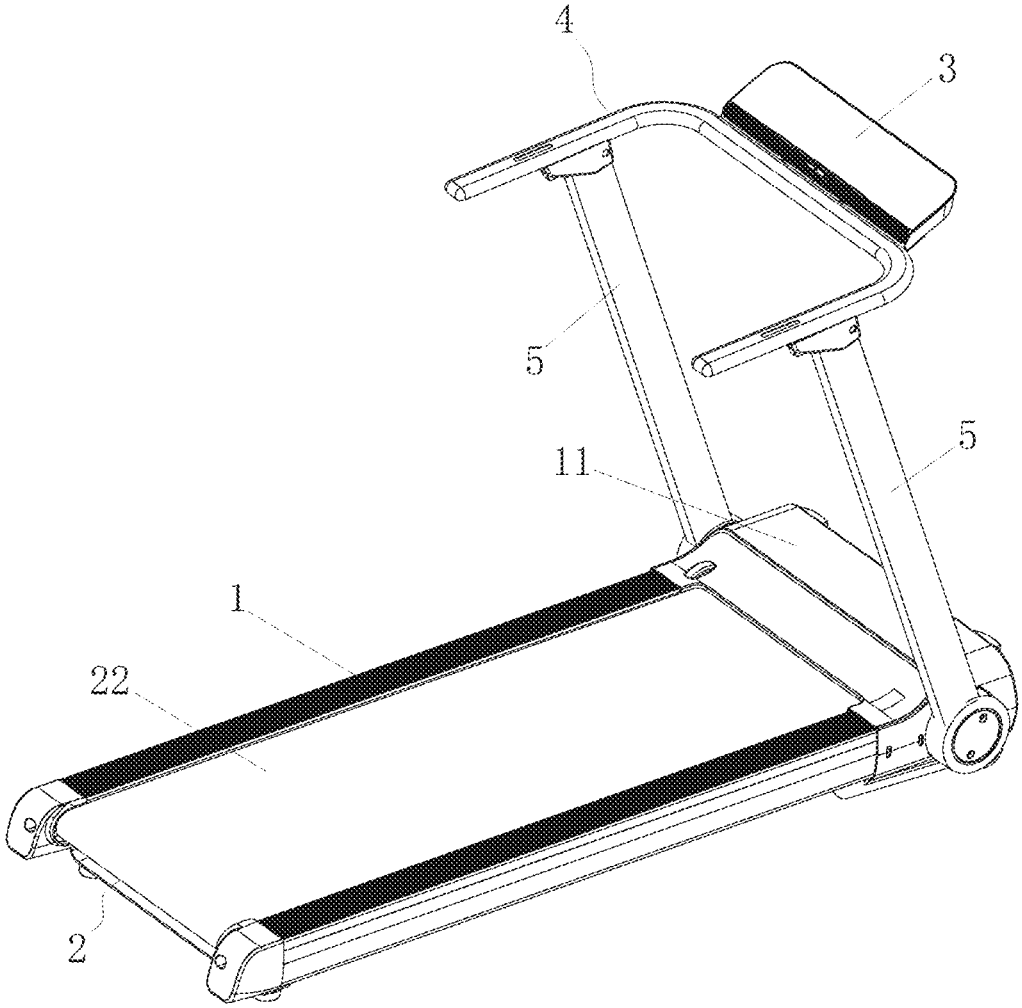
FIG. 1 illustrates a top perspective diagram of the present invention.

The present invention is further described in detail in conjunction with the drawings and the exemplary embodiments.

Embodiment 1: as shown in FIG. 1 to FIG. 15, a foldable treadmill includes a chassis 1, a running platform 2, a dashboard 3, a dashboard bracket 4 and two support rods 5, and the running platform 2 is mounted on the chassis 1.

The running platform 2 includes two parallel rollers 21 and a support plate 20 mounted on the chassis 1, and cyclically-movable running belts 22 are mounted between the two rollers 21; the support plate 20 passes through the running belts 22 and both sides thereof are fixedly connected on the chassis 1, a running motor 23 is mounted on the chassis 1, one of the rollers 21 is mounted with a driven pulley 24, a driving shaft of the running motor 23 is mounted with a driving pulley 25, the driving pulley 25 and the driven pulley 24 are connected to each other through a transfer belt 26, and a rotating speed of the running motor 23 is controlled by the dashboard 3. It is convenient to form an electric treadmill, and exercisers can get more experience. A front cover plate 11 is mounted on a front portion of the chassis 1, and the front cover plate 11 covers the running motor 23, the driving pulley 25, the driven pulley 24 and the transfer belt 26 to enhance usage safety.

Lower portions of the two support rods 5 are pivotally connected to both sides of the front portion of the chassis 1 through two rotating pins 51, respectively, upper portions of the two support rods 5 are connected together through the dashboard bracket 4, and the dashboard 3 is mounted on the dashboard bracket 4; the dashboard bracket 4 includes two armrests 41 and a crossbar 42 connecting the two armrests 41, and the two armrests 41 are integrally connected with the crossbar 42; the two armrests are connected on the upper portions of the two support rods 5, respectively, the dashboard 3 is pivotally connected on the crossbar 42, a limiting structure for mutual positioning is further disposed between the dashboard 3 and the crossbar 42, the limiting structure includes two support plates 43 fixedly connected on the crossbar 42, the dashboard 3 is pivotally connected with the two support plates 43, each of the support plates 43 is provided with a limiting slot 431, the dashboard 3 is provided with two limiting projections, the two limiting projections cooperate with the two limiting slots 431, respectively to position the dashboard 3. This can facilitate the folding and positioning of the dashboard 3.

Figure 2:
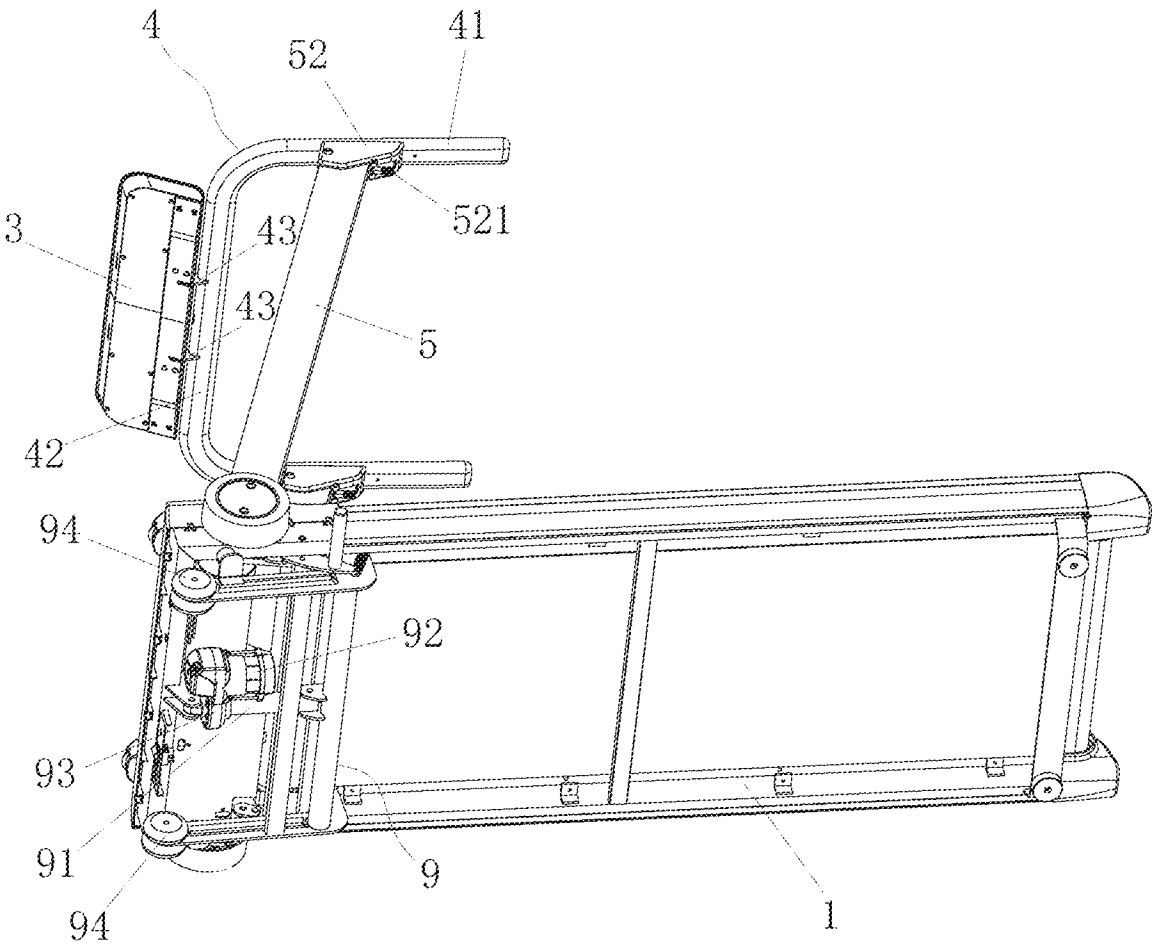
FIG. 2 illustrates a bottom perspective diagram of the present invention.
Figure 3:
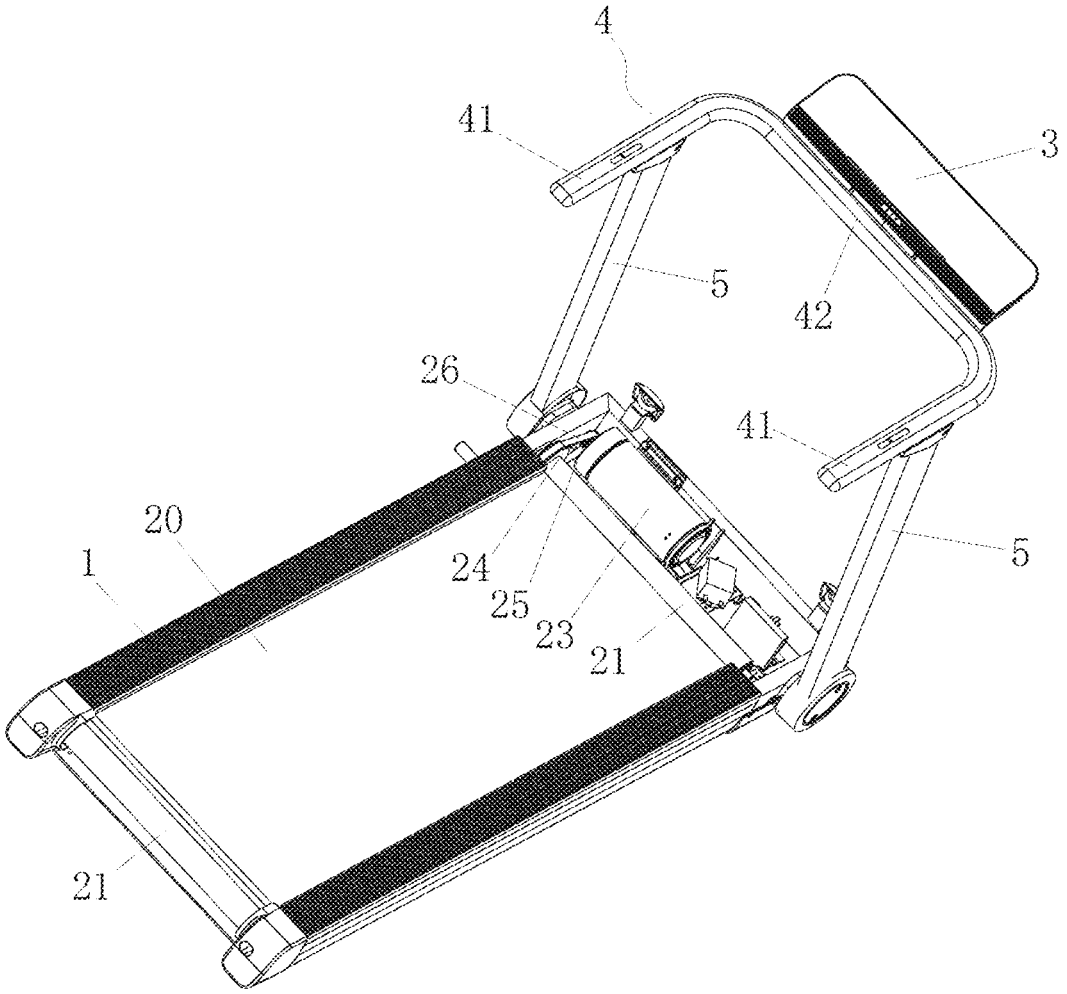
FIG. 3 illustrates a top perspective diagram of running belts and a front cover plate being hidden of the present invention.
Figure 4:
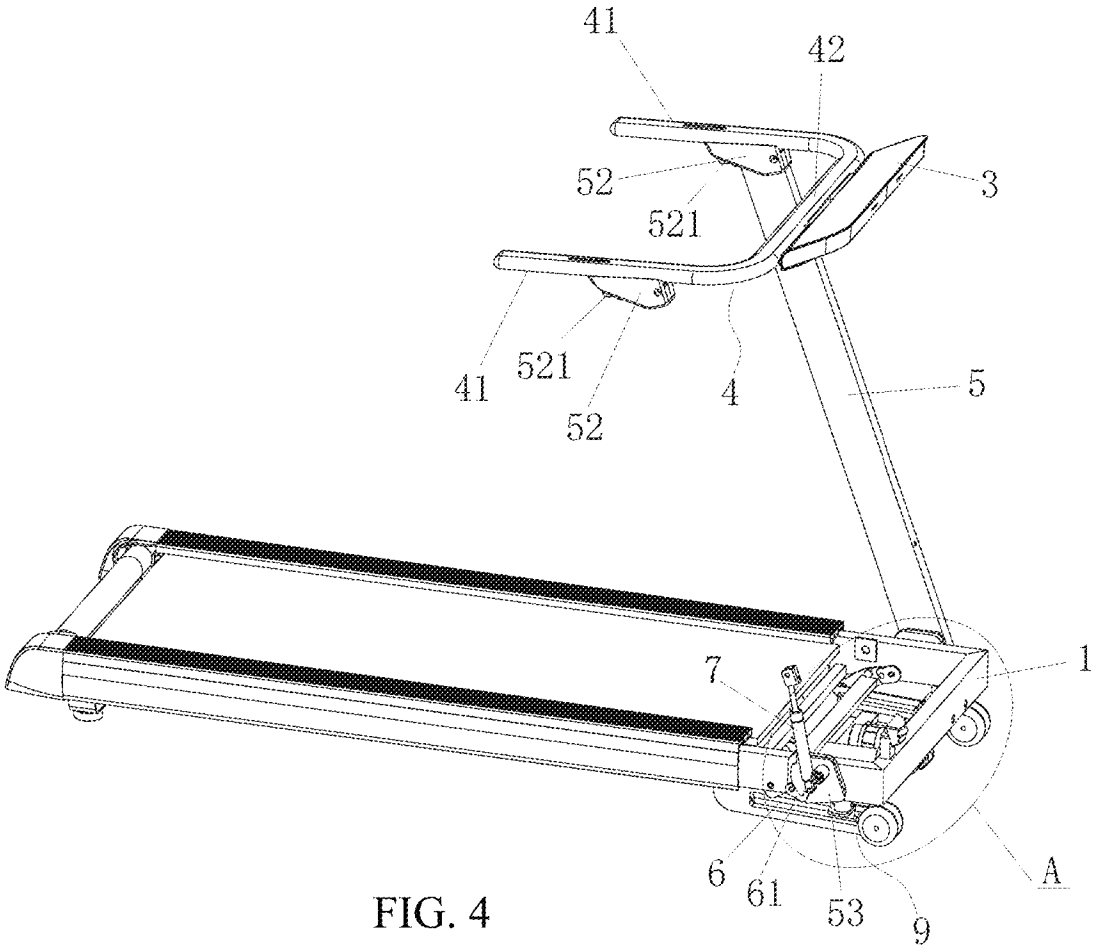
FIG. 4 illustrates a top perspective diagram of a support rod and some parts being hidden from an angle of the present invention.
Figure 5:
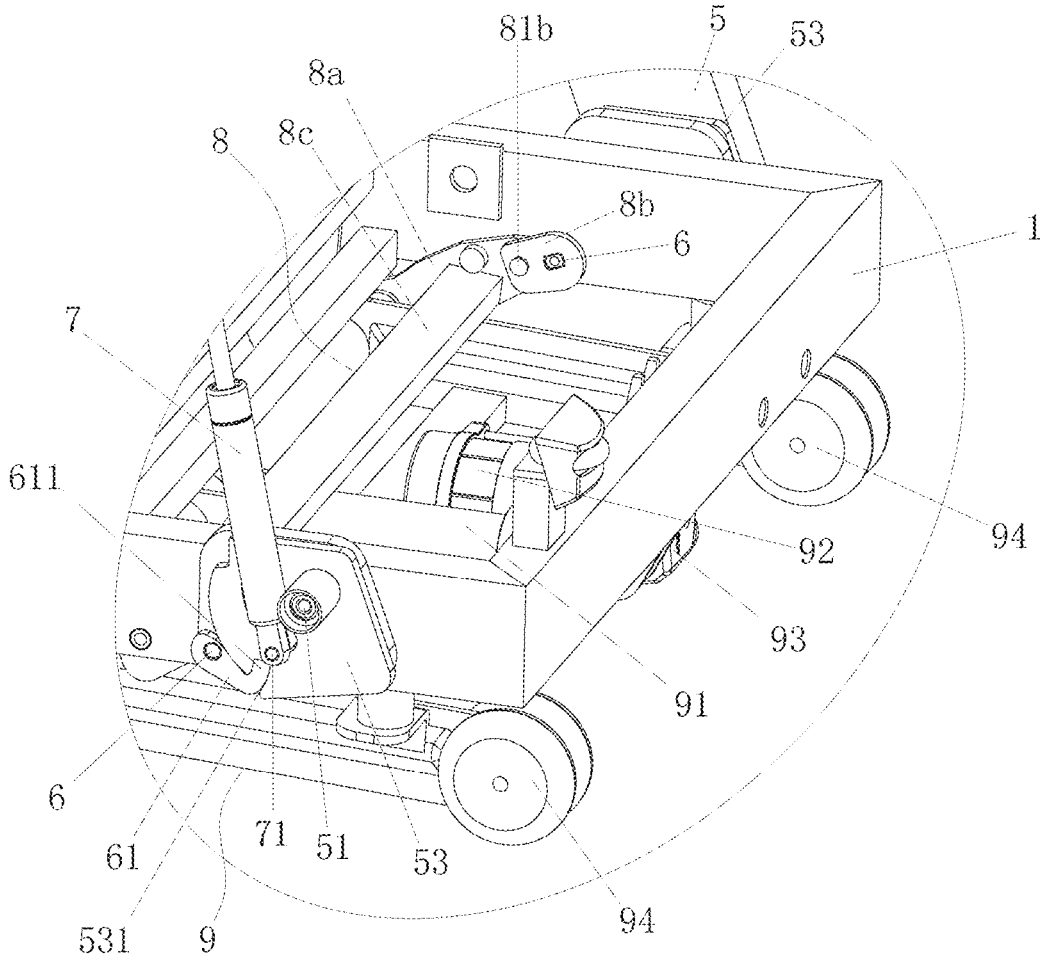
FIG. 5 illustrates an enlarged diagram of part A of FIG. 4.
Figure 6:
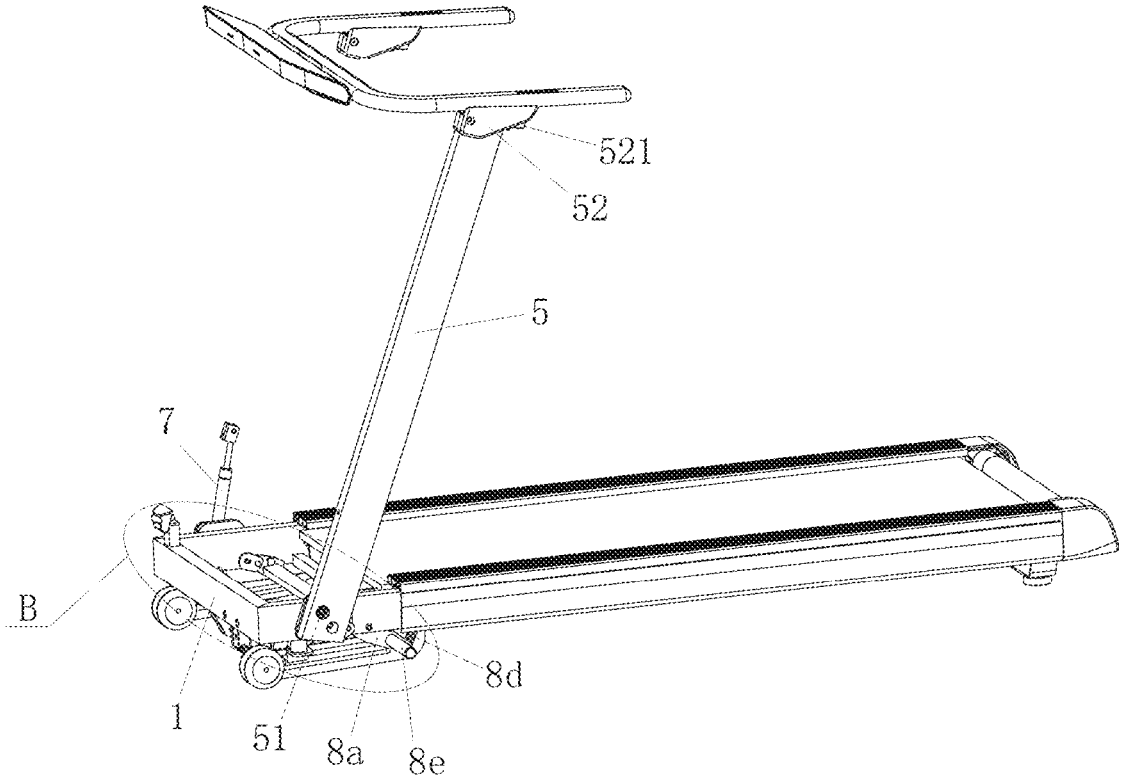
FIG. 6 illustrates a top perspective diagram of the present invention hiding a support rod and some parts from another angle.
Figure 7:
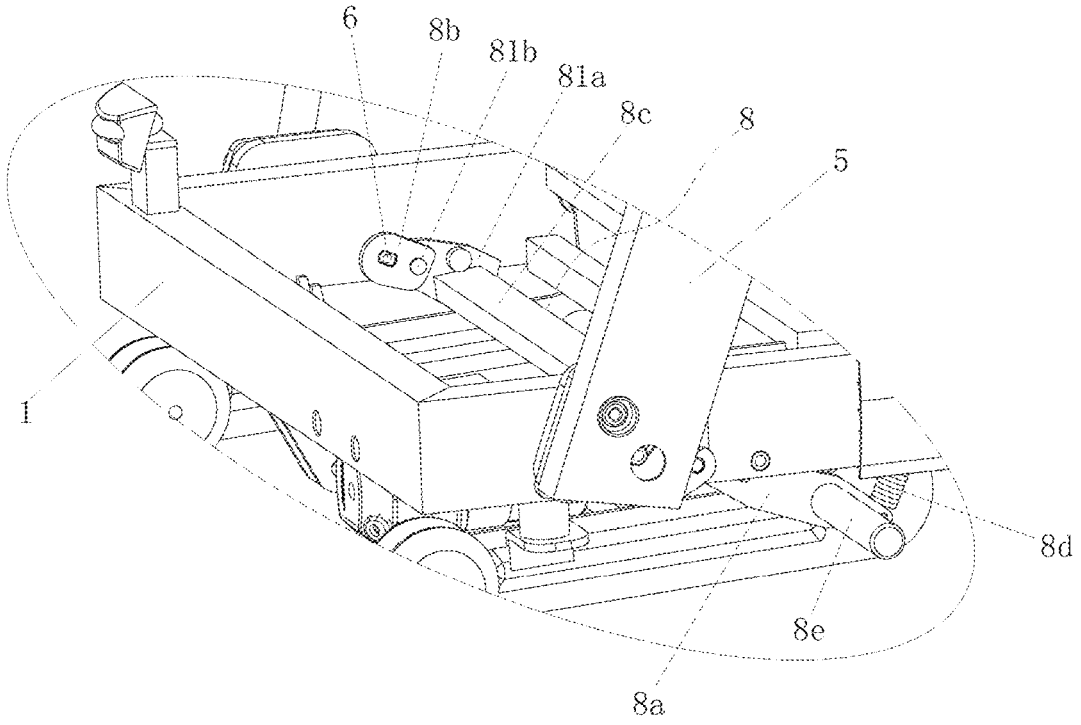
FIG. 7 illustrates an enlarged diagram of part B of FIG. 6.
Figure 8:
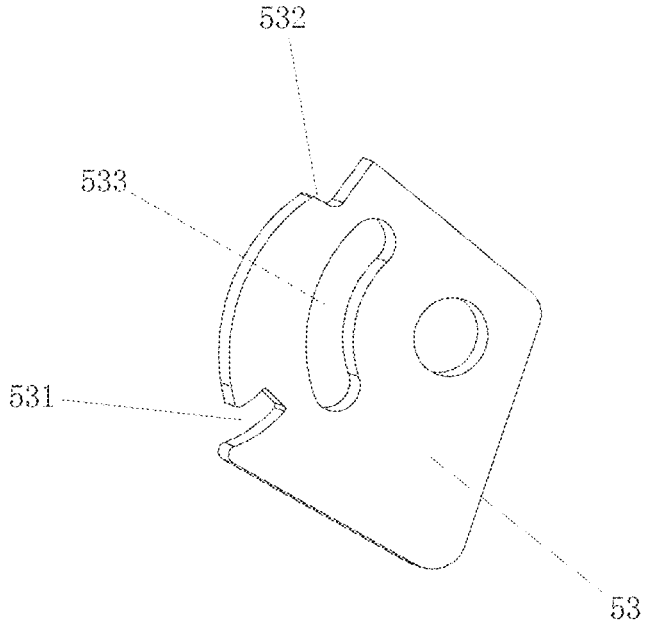
FIG. 8 illustrates a perspective diagram of a fixing plate.
Figure 9:
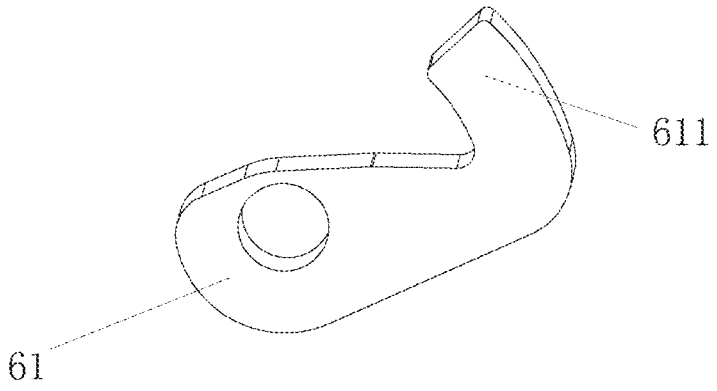
FIG. 9 illustrates a perspective diagram of a hook.
Figure 10:
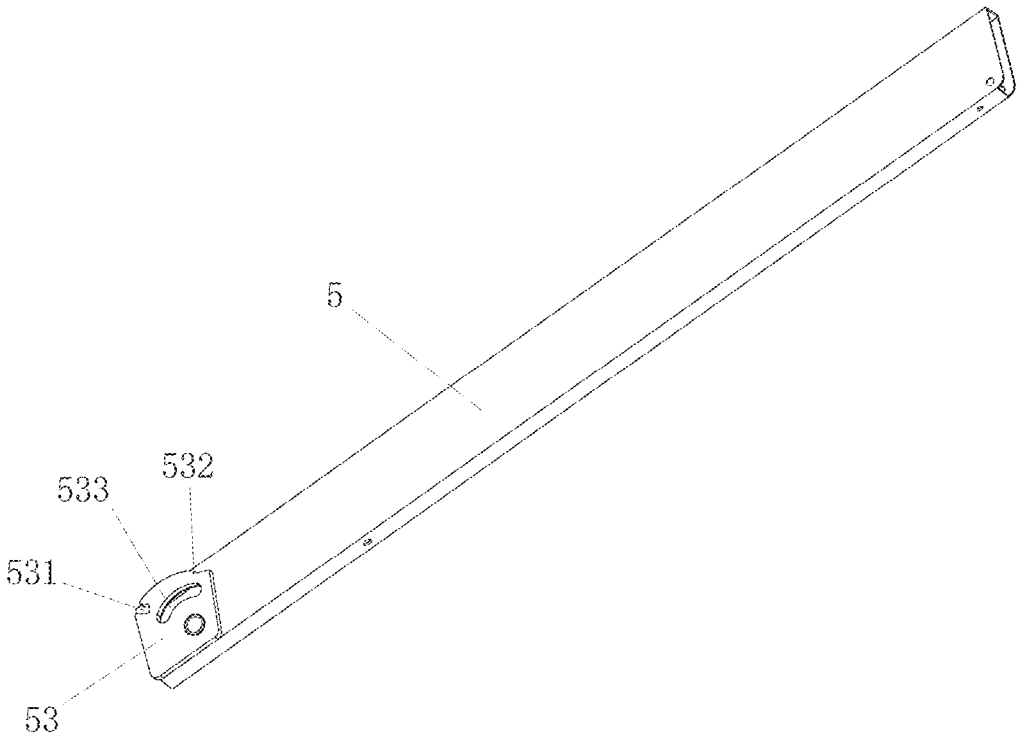
FIG. 10 illustrates a perspective diagram of support rods connected together with the fixing plate.
Figure 11:
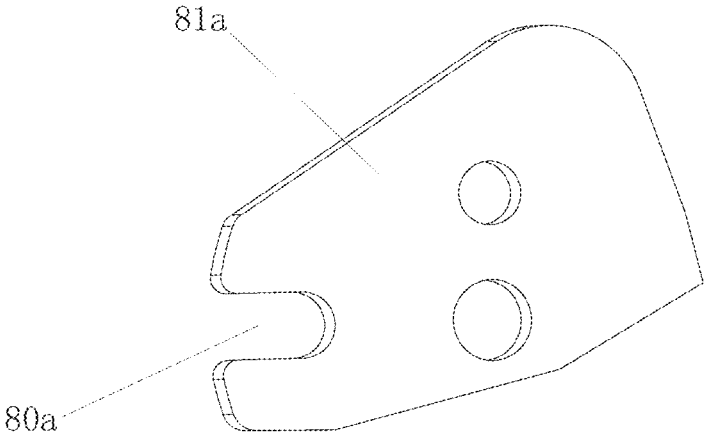
FIG. 11 illustrates a perspective diagram of a right driving arm.
Figure 12:
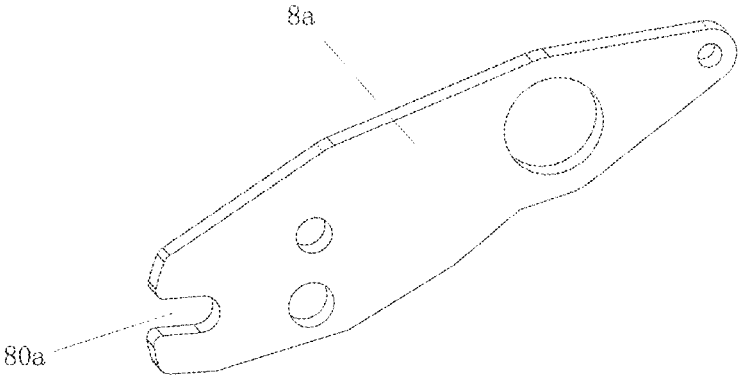
FIG. 12 illustrates a perspective diagram of a left driving arm.
Figure 13:
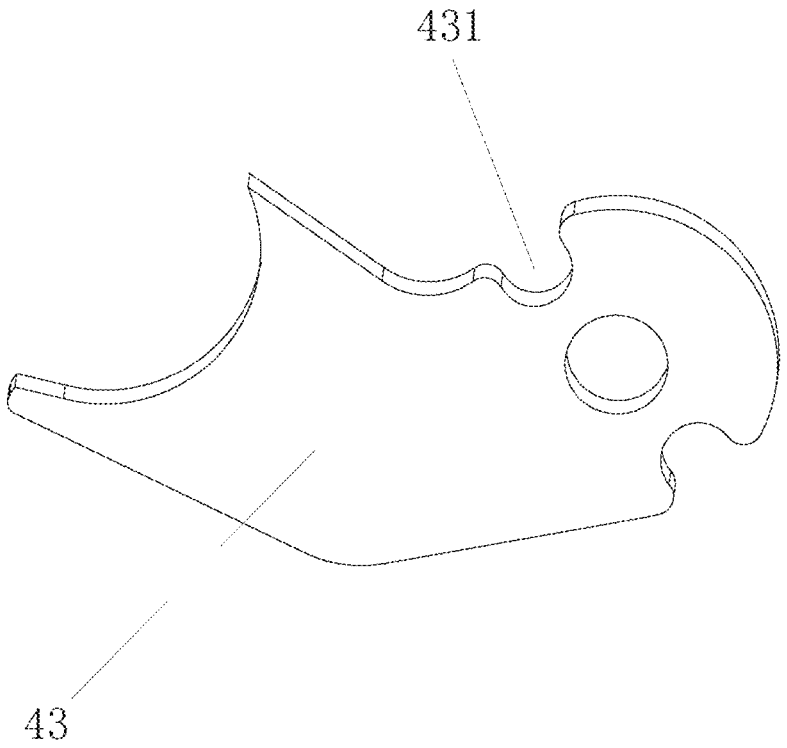
FIG. 13 illustrates a perspective diagram of a support plate.

Through further illustration in FIGS. 2, 4 and 5, a lower portion of each of the armrests 41 is fixedly connected with a positioning member 44, a side of the positioning member 44 is hinged with the support rod 5, the positioning member 44 is mounted with a shiftable positioning pin 440, a spring is coiled around the positioning pin 440, an end of the spring abuts against the positioning member 44 and the other end abuts against the positioning pin 440 so that an end of the positioning pin 440 protrudes from the positioning member 44, the support rod 5 is provided with a positioning hole 50, and the positioning pin 440 is inserted into the positioning hole 50 when the armrest 40 leans toward the support rod 5; an upper end of the support rod 5 is fixedly connected with a housing 52, the housing 52 is pivotally connected with a button 521, the button 521 drives the positioning pin 440 to be separated from the positioning hole 50 when the button 521 is pressed, and the armrest 41 and the positioning member 44 are rotatable relative to the support rod 5. This enables the entire dashboard bracket 4 to be rotatably positioned and folded.

Each of both sides of the front portion of the chassis 1 is pivotally connected with a pin shaft 6, two pin shafts 6 are parallel to each other, an end of each pin shaft 6 is fixedly connected with a hook 61, an inner side of a lower portion of each of the support rods 5 is fixedly connected with a fixing plate 53, the fixing plate 53 is provided with a clamp positioning slot 53 and a limiting part 532, a hook end 611 of the hook 6 can be clamped into the clamp positioning slot 531 or cooperate with the limiting part 532 with the rotation of the support rod 5, and the hook 61 cooperates with the clamp positioning slot 531 to limit the rotation of the support rod 5 to position the support rod 5; the support rod 5 is in a standing state when the hook end 611 of the hook 61 cooperates with the clamp positioning slot 531, and the support rod 5 is in an inclined state and leans toward the chassis 1 when the hook 61 cooperates with the limiting part 532.

The support rod 5 is a square tube, the fixing plate 53 is welded on an inner side surface of the lower portion of the support rod 5, a relief through hole 533 is correspondingly disposed between the inner side surface of the lower portion of the support rod 5 and the fixing plate 53, the relief through hole 533 is an arc-shaped hole, a fixing pin 71 passes through the relief through hole 533 so that an end thereof is fixedly connected on the chassis 1 and the other end thereof is hinged with an end of a buffer cylinder 7, the buffer cylinder 7 is disposed so as to pass through a middle of the support rod 5, and the other end of the buffer cylinder 7 is hinged on the support rod 5.

The two pin shafts 6 are driven to rotate or reset synchronously through a linkage mechanism 8 so that the two pin shafts 6 can drive the hook end 611 of a hook 6 to be separated from the clamp positioning slot or cooperate with a limiting part 532, respectively.

The linkage mechanism 8 includes two driving arms and two crank arms 8*b*, the two driving arms are respectively a left driving arm 8*a* and a right driving arm 81*a*, an end of each crank arm 8*b* is fixedly connected with the other end of the pin shaft 6, the other end of each crank arm 8*b* is fixedly connected with a driving pin 81*b*, the left driving arm 8*a* and the right driving arm 81*a* are respectively pivotally connected on the chassis 1, an end of each of the left driving arm 8*a* and the right driving arm 81*a* is movably connected with a driving pin 81*b*, the left driving arm 8*a* and the right driving arm 81*a* are fixedly connected together through a connecting rod 8*c*, the left driving arm 8*a* is further connected with the chassis 1 through a tension spring 8*d*, the left driving arm 8*a* is fixedly connected with a pedal rod 8*e*, the left driving arm 8*a* and the right driving arm 81*a* rotate simultaneously when the pedal rod is depressed and then drive the two crank arms 8*b*, the two pin shafts 6 and the two hooks 61 to rotate through two driving pins 81*b*, respectively, and the tension spring 8*d* drives the left driving arm 8*a* and the right driving arm 81*a* to reset.

An end of each of the left driving arm 8*a* and the right driving arm 81*a* is provided with a U-shaped groove 80*a* and is movably connected with a driving pin 81*b* through the U-shaped groove 80*a*.

A front lower portion of the chassis is hinged with a rotating rack 9, the rotating rack 9 is hinged with an end of a driving rod 91, an adjusting motor 92 is connected on a reducer 93, the reducer 93 is hinged on the chassis 1, an outside of an output shaft of the reducer 93 is provided with external thread, the driving rod 91 is fixedly connected with a nut, the external thread on the outside of the output shaft cooperates with inner thread of the nut, and both sides of a front end of the rotating rack 9 are mounted with two support wheels 94. The rotating rack 9 can be driven to rotate through rotation of the adjusting motor 92 so that an inclination degree of the chassis 1 can be changed to change sport effect. The adjusting motor 92 and the reducer 93 are also covered with a bottom case, and the bottom case is connected on the chassis 1.

Figure 14:
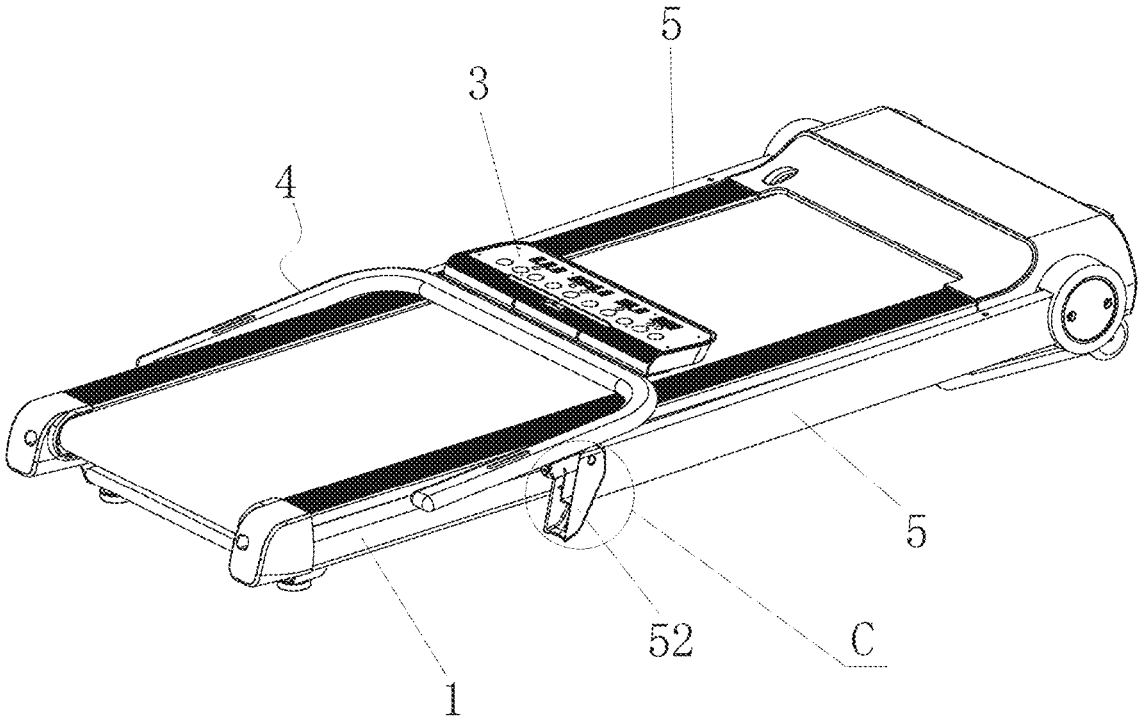
FIG. 14 illustrates a top perspective diagram of the present invention in a folded state.
Figure 15:
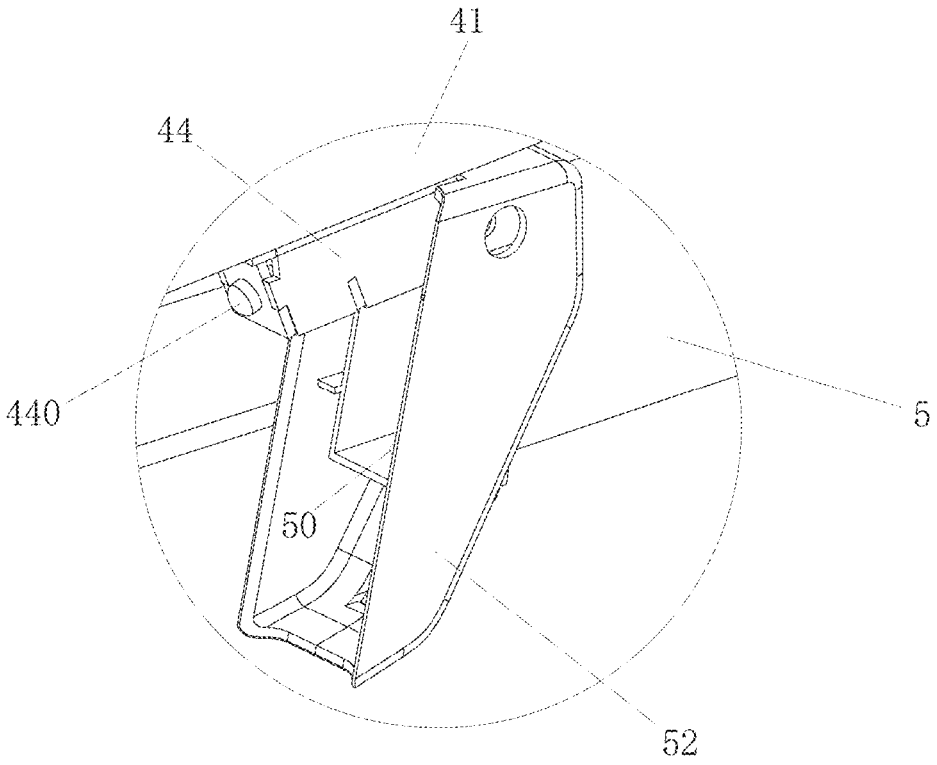
FIG. 15 illustrates an enlarged diagram of part C of FIG. 14.

An operation process of the folding of the present embodiment is as follows: FIG. 1 illustrates a perspective diagram of the present embodiment in a usable state, at the time, if the treadmill is not used, the dashboard 3 is first rotatably folded relative to the dashboard bracket 4, then the dashboard 3 and the dashboard bracket 4 are rotatably folded relative to the two support rods 5; then the pedal rod 8*e* are depressed with a foot, the left driving arm 8*a* and the right driving arm 81*a* rotate simultaneously and then drive the two crank arms 8*b*, the two pin shafts 6 and the two hooks 61 to rotate in a clockwise direction through two driving pins 81*b*, respectively, the hook ends 611 of the two hooks 61 are synchronously separated from the clamp positioning slots 531 on the two fixing plates 53 to release the rotation limitation of the two support rods 5, then one or two support rods 5 are toggled with a hand to rotate such that the support rods 5 lean toward the chassis 1; subsequently, the pedal rod 8*e* are released, the tension spring 8*d* drives the left driving arm 8*a* and the right driving arm 81*a* to reset, the left driving arm 8*a* and the right driving arm 81*a* drive the two crank arms 8*b*, the two pin shafts 6 and the two hooks 61 to rotate in a counter clockwise direction through two driving pins 81*b*, respectively, so that the hook ends 611 of the two hooks 61 are synchronously clamped on the limiting parts 532 of the two fixing plates 53. The rotation limitation is again performed on the two support rods 5 to enable the two support rods 5 in a stable folded state, as shown in FIG. 14. The operation is convenient, the speed is fast and the action is reliable, and the storage space is effectively reduced when the treadmill is idle.

What is described above is merely an optimum embodiment of the present invention, and the equivalent changes made by those skilled in the art according to the claims all fall within a scope for protection of the present application.

What is claimed is:

1. A foldable treadmill, comprising:

a chassis;

a running platform, mounted on the chassis;

a dashboard;

a dashboard bracket, wherein the dashboard is mounted on the dashboard bracket; and two support rods, wherein upper portions of the two support rods are connected together through the dashboard bracket;

wherein lower portions of the two support rods are pivotally connected to two sides of a front portion of the chassis, respectively, and each of the lower portions of the two support rods is provided with a clamp positioning slot;

wherein each of the two sides of the front portion of the chassis is pivotally connected with a pin shaft, and the two pin shafts are parallel to each other; an end of each of the two pin shafts is fixedly connected with a hook, a hook end of the hook is clamped into the clamp positioning slot on each of the two support rods, respectively, with a rotation of the two support rods, and the rotation of the two support rods is restricted through cooperation of the hooks and the clamp positioning slots, respectively; and wherein the two pin shafts are driven to rotate or reset synchronously through a linkage mechanism so that the two pin shafts drive the hook ends of the hooks to be separated from or clamped into the clamp positioning slots, respectively.

2. The foldable treadmill of claim 1, wherein each of the lower portions of the two support rods is fixedly connected with a fixing plate, the clamp positioning slot on each of the two support rods is disposed on the fixing plate, the fixing plate is further provided with a limiting part, each support rod is in a standing state when the corresponding hook end of the hook cooperates with the corresponding clamp positioning slot, and each support rod is in an inclined state and leans toward the chassis when the corresponding hook end of the hook cooperates with the corresponding limiting part.

3. The foldable treadmill of claim 2, wherein each support rod is a square tube, the corresponding fixing plate is welded on an inner side surface of the lower portion of the support rod, a relief through hole is correspondingly disposed between the inner side surface of the lower portion of the support rod and the fixing plate, a fixing pin passes through the relief through hole so that a first end of the fixing pin is fixedly connected on the chassis and a second end of the fixing pin is hinged with a first end of a buffer cylinder, a second end of the buffer cylinder is hinged on the support rod, and the buffer cylinder is disposed so as to pass through a middle of the support rod.

4. The foldable treadmill of claim 1, wherein the dashboard bracket comprises two armrests and a crossbar connecting the two armrests, the two armrests are connected at the upper portions of the two support rods, respectively, the dashboard is pivotally connected on the crossbar, and a limiting structure for mutual positioning is further provided between the dashboard and the crossbar.

5. The foldable treadmill of claim 4, wherein for each respective connection between the two armrests and the upper portions of the two support rods:

a lower portion of each armrest is fixedly connected with a positioning member;

a side of the positioning member is hinged with an upper end of the support rod;

a shiftable positioning pin is mounted on the positioning member;

a spring is coiled around the shiftable positioning pin, a first end of the spring abuts against the positioning member and a second end of the spring abuts against the shiftable positioning pin so that an end of the shiftable positioning pin protrudes from the positioning member;

a positioning hole is provided at the upper end of the support rod displaced from the side of the positioning member, and the end of the shiftable positioning pin is inserted into the positioning hole when the armrest leans toward the support rod;

a housing is fixedly connected with the upper end of the support rod;

the housing is pivotally connected with a button, the button drives the shiftable positioning pin to be separated from the positioning hole when the button is pressed, and the armrest and the positioning member are rotatable relative to the support rod.

6. The foldable treadmill of claim 4, wherein the limiting structure comprises two support plates that are fixedly connected with the crossbar, the dashboard is pivotally connected with the two support plates, each of the support plates is provided with a limiting slot, the dashboard is provided with two limiting projections, the two limiting projections and the two limiting slots cooperate with each other, respectively to position the dashboard.

7. The foldable treadmill of claim 4, wherein the two armrests are integrally connected with the crossbar.

8. The foldable treadmill of claim 1, a front lower portion of the chassis is hinged with a rotating rack, the rotating rack is hinged with an end of a driving rod, an adjusting motor is connected on a reducer, the reducer is hinged on the chassis, an outside of an output shaft of the reducer is provided with external thread, the driving rod is fixedly connected with a nut, the external thread on the outside of the output shaft cooperates with inner thread of the nut, and two sides of a front end of the rotating rack are respectively mounted with two support wheels.

9. The foldable treadmill of claim 1, wherein the linkage mechanism comprises two driving arms and two crank arms, a first end of each of the crank arms is fixedly connected with the two pin shafts, respectively, and a second end of each of the crank arms is fixedly connected with two driving pins, respectively, each of the driving arms is pivotally connected on the chassis, an end of each of the driving arms is movably connected with the two driving pins, respectively, the two driving arms are fixedly connected together through a connecting rod, at least one driving arm and the chassis are connected to each other through a tension spring, at least one driving arm is fixedly connected with a pedal rod, the two driving arms rotate simultaneously when the pedal rod is depressed and then drive the two crank arms, the two pin shafts and the two hooks to rotate through the two driving pins, and the tension spring drives the two driving arms to reset.

10. The foldable treadmill of claim 9, wherein the end of each of the driving arms is provided with a U-shaped groove and is movably connected with each of the two driving pins, respectively, through the corresponding U-shaped groove.

* * * * *